US005520076A

United States Patent [19]

Junkers

[11] Patent Number: 5,520,076

[45] Date of Patent: May 28, 1996

[54] SOCKET FOR TURNING A THREADED CONNECTOR BY A POWER TOOL

[76] Inventor: John K. Junkers, 7 Arrowhead La., Saddle River, N.J. 07540

[21] Appl. No.: 253,712

[22] Filed: Jun. 3, 1994

Related U.S. Application Data

[63] Continuation-in-part of Ser. No. 7,608, Jan. 22, 1993, abandoned.

[51] Int. Cl.[6] ..... B25B 23/144

[52] U.S. Cl. ..... 81/479; 81/124.6; 73/761; 73/862.321

[58] Field of Search ..... 81/121.1, 124.6, 81/467, 469, 479, 480, 429; 173/180–182; 73/1 C, 761, 862.21–862.23, 862.08, 862.33–862.35

[56] References Cited

U.S. PATENT DOCUMENTS

| | | | |
|---|---|---|---|
| 4,328,720 | 5/1982 | Shiel | 81/124.6 |
| 4,709,182 | 11/1987 | Wenske et al. | 81/479 X |
| 4,759,225 | 7/1988 | Reynertson et al. | 81/479 X |
| 5,115,701 | 5/1992 | Lehnert | 81/467 |
| 5,123,313 | 6/1992 | Andersson | 81/121.1 X |

*Primary Examiner*—James G. Smith
*Attorney, Agent, or Firm*—Michael J. Striker

[57] ABSTRACT

A socket for turning a threaded connector by a power tool comprises a socket body, connecting formations for connecting a socket body to a power tool, engaging formations provided in the socket body for engaging with a threaded connector, and strain measuring formations arranged in the socket body so that when the socket body engages a threaded connector and a tool is connected with the socket body and turns the socket body and therefore the threaded connector, the strain measuring formations measure a turning resistance of the socket relative to a power applied by the power tool for turning the threaded connector.

3 Claims, 1 Drawing Sheet

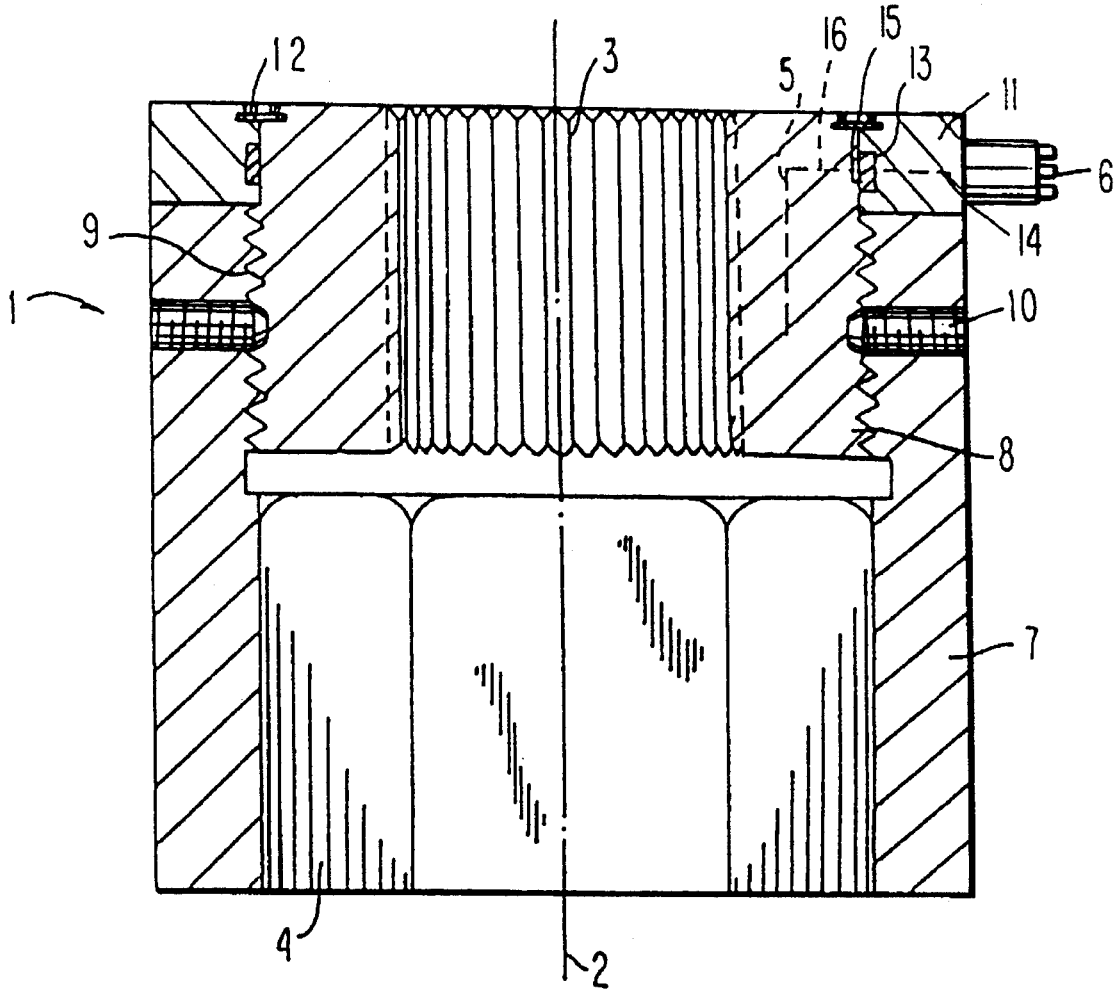
12
3
16
15
5
13
11
6
9
14
1
10
8
7
4
2

SOCKET FOR TURNING A THREADED CONNECTOR BY A POWER TOOL

CROSS-REFERENCE TO RELATED APPLICATION

This application is a continuation-in-part of patent application Ser. No. 08/007,608 filed on Jan. 22, 1993 abandoned.

BACKGROUND OF THE INVENTION

The present invention relates to sockets which are used in conjunction with a power tool, such as for example, a wrench, for turning a threaded connector, such as for example, a nut.

The problem for a consumer who uses power tool for turning threaded connectors, is that the consumer would like to know what exact torque is being applied to each nut and, if possible, he would like to obtain a computer reading for each individual nut. In the past the applicant provided a torque chart which was based on the pressure applied to the power tool. This torque chart was established by the applicant on a calibration stand where he tested the tool prior to shipment, for pressure versus torque output. The problem with this approach is that when something goes wrong with the tool and the pressure can build up, the operator might think that he has obtained the desired torque. In reality he only obtained the pressure in the system. In addition the customer likes to calibrate the tools used during assembly prior to the assembly, which requires the purchase of a calibration stand.

SUMMARY OF THE INVENTION

Accordingly, it is an object of the present invention to provide a device and in particular a socket which eliminates the disadvantages of the prior art.

In keeping with these objects and with others which will become apparent hereinafter, one feature of the present invention resides, briefly stated, in a socket which has a socket body, connecting means for connecting a socket body to a power tool, engaging means provided in the socket body for engaging with a threaded connector, and strain measuring means arranged in the socket body so that when the socket body engages a threaded connector and a tool is connected with the socket body and turns the socket body and therefore the threaded connector, the strain measuring means measure a turning resistance of the socket relative to a power applied by the power tool for turning the threaded connector.

When the socket is designed in accordance with the present invention, the measurement of the turning resistance of the nut relative to the turning force of the drive portion of the power tool is performed, and the torque reading equals exactly the torque applied. Since the strain measuring means such as strain gauges in the socket is connected to a read-out device, it is possible to print out the results. Thereby, the studs to be tightened can be numbered and added later to the record of the job.

Furthermore, if a customer just requires a tool calibration prior to the job, it can be done by simply applying the socket to the tool and measuring the pressure versus torque output on a tight nut.

In accordance with an especially advantageous feature of the present invention, the socket has a housing and an adaptor which is inserted in the housing and is provided with the strain measuring means. When the socket is designed in accordance with these features, one single adaptor can be used for a variety of socket/nut sizes.

In accordance with a further advantageous feature of the present invention, the electrical conductors leading from the strain measuring means outwardly of the socket are arranged in a guide which is freely movable relative to the socket to prevent tangling up the conductors during turning of the socket.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing a socket for turning a threaded connector by a power tool in accordance with the present invention.

DESCRIPTION OF THE PREFERRED EMBODIMENTS

A socket for turning a threaded connector by a power tool in accordance with the present invention has a socket body which is identified as a whole with reference numeral 1. In a shown example the socket body is cylindrical and has an axis 2. The socket body has one axial end provided with means 3 for connecting the socket body with a not shown power tool. The connecting means 3 can be formed by a plurality of axially extending splines. The socket body further has another end provided with means 4 for engaging a threaded connector such as a nut. The engaging means 4 is formed in the shown embodiment as a hexagonal opening.

In accordance with the present invention, the socket is provided with strain measuring means arranged in the socket body 1 as identified with reference numeral 5. This strain measuring means can be formed as well known mechano-electrical strain gauges incorporated in the socket body 1 and connected by electrical conductor 6 with not shown strain evaluating device provided, for example, with a read-out.

The socket in accordance with the present invention operates in the following manner: When a power tool, for example a wrench is connected with the socket by interengagement of the power tool with the splines 3 of the socket, the socket is applied onto a threaded connector such as a nut by applying its hexagonal opening 4 on the nut, the power tool is actuated and turns the socket body 1, so that the socket body 1 turns the nut. During turning of the nut, the strain measuring means 5 measure the turning resistance of the socket relative to the power applied by the power tool.

In accordance with an advantageous embodiment of the invention, the socket body 1 has a housing 7 and an adaptor 8 arranged in the housing. The housing and the adaptor are formed as hollow bodies of revolution, and the adaptor 8 has an outer cylindrical portion provided with a thread which engages with a thread in an inner cylindrical opening of the housing 7 as identified with reference numeral 9. The adaptor 8 is provided with the splines 3 for connecting to the power tool, while the housing 7 is provided with the hexagonal opening 4 for engaging with the nut. The adaptor and the housing are connected with one another by holding screws 10. In such a construction one single adaptor can be provided for a variety of socket/nut sizes.

In accordance with a further advantageous feature of the present invention, the electrical conductors 6 which extend from the strain gauges 5 outwardly of the socket to the evaluating device are guided so that they do not tangle up during turning of the socket. In particular, a guiding member 11 is provided for this purpose. The guiding member 11 is formed as a ring which is freely turnable on an upper cylindrical portion of the adaptor 8 and turnably held on it by a retainer 12. The electrical conductors, for example an electrical cable, is guided through the guiding member 11. During turning of the socket, the adaptor 8 and the housing 7 turn, while the guiding member 11 is retained substantially non-turnable to prevent tangling up of the electrical conductor 6.

In order to provide electrical connection between the strain gauges 5 and the outside electrical conductor 6, a conductive metal ring 13 is embedded in the inner surface of the guiding member 11 and connected with the outside conductor 6 by an additional conductor 14, while the strain gauges 5 is connected with an end contact 15 by an additional conductor 16. The end contact 15 is always in electrical contact with the metal ring 13, as can be seen from the drawing.

It will be understood that each of the elements described above, or two or more together, may also find a useful application in other types of constructions differing from the types described above.

While the invention has been illustrated and described as embodied in a socket for turning a threaded connector by a power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A socket for turning a threaded connector by a power tool, comprising a socket body; connecting means for connecting said socket body to a power tool; engaging means provided in said socket body for engaging with a threaded connector; strain measuring means arranged in an interior of said socket body so that when said socket body engages a threaded connector and a tool is connected with said socket body and turns said socket body and therefore said threaded connector, said strain measuring means measure a turning resistance of the socket relative to a power applied by the power tool for turning the threaded connector; electrical conductor means extending from strain measuring means outwardly of said socket body; and guiding means for guiding said electrical conductor means, said guiding means including a guiding member through which said electrical conductor means extend and which is freely movable relative to said socket body so that during turning of said socket body, said electrical conductor means do not tangle up, said socket body having a substantially cylindrical portion, said guiding member being formed as a substantially ring-shaped member, which is freely turnable on said substantially cylindrical portion of said socket body.

2. A socket for turning a threaded connector by a power tool, comprising a socket body having an axis; strain measuring means arranged inside said socket body; connecting means for connecting said socket body to a power tool, said connecting means being formed in a first axial portion of said socket body; engaging means provided in said socket body for engaging with a threaded connector, said engaging means being formed in a second axial portion of said socket body which is adjacent to said first axial portion so that said connecting means and said engaging means are spaced from one another by a distance which prevents occurrence of torque in said socket body and therefore when said socket body engages a threaded connector by said engaging means and a power tool is connected with said socket body by said connection means and turns said socket body and therefore the threaded connector, said strain measuring means measure a turning resistance of the socket relative to a power applied by the power tool for turning the threaded connector and therefore measure a turning resistance of the threaded connector relative to the power applied by the power tool for turning the threaded connector.

3. A socket as defined in claim 2, wherein said socket body is a tubular body.

* * * * *